US007808216B2

(12) United States Patent
Kim

(10) Patent No.: US 7,808,216 B2
(45) Date of Patent: Oct. 5, 2010

(54) PHASE SHIFT CIRCUIT AND BACKLIGHT UNIT HAVING THE SAME

(75) Inventor: Taek Soo Kim, Gwangju-si (KR)

(73) Assignee: LG Innotek Co., Ltd., Seoul (KR)

( * ) Notice: Subject to any disclaimer, the term of this patent is extended or adjusted under 35 U.S.C. 154(b) by 350 days.

(21) Appl. No.: 12/104,236

(22) Filed: Apr. 16, 2008

(65) Prior Publication Data

US 2008/0258639 A1 Oct. 23, 2008

(30) Foreign Application Priority Data

Apr. 17, 2007 (KR) ..... 10-2007-0037531
Jun. 19, 2007 (KR) ..... 10-2007-0059776

(51) Int. Cl.
*G05F 3/00* (2006.01)
*G09G 3/36* (2006.01)

(52) U.S. Cl. ..... 323/212; 345/102; 315/246

(58) Field of Classification Search ..... 323/212; 315/209 R, 224, 225, 226, 246, 250, 254, 315/276; 345/102
See application file for complete search history.

(56) References Cited

U.S. PATENT DOCUMENTS 4,663,702 A * 5/1987 Tanaka ..... 363/65
6,501,234 B2 * 12/2002 Lin et al. ..... 315/307
6,750,842 B2 * 6/2004 Yu ..... 345/102
7,560,914 B2 * 7/2009 O'Driscoll et al. ..... 323/267
2003/0178951 A1 9/2003 Park et al.
2006/0072568 A1 * 4/2006 Vaananen ..... 370/389

FOREIGN PATENT DOCUMENTS

KR 10-2003-0030513 A 4/2003
KR 10-2003-0075626 A 9/2003

* cited by examiner

*Primary Examiner*—Thuy Vinh Tran
(74) *Attorney, Agent, or Firm*—Birch, Stewart, Kolasch & Birch, LLP

(57) ABSTRACT

Disclosed is a phase shift circuit. The phase shift circuit comprises a frequency multiplier outputting a square wave signal by frequency-multiplying a reference signal, a frequency synchronizer receiving the square wave signal to output a triangle wave signal, and a PWM nodule receiving the triangle wave signal to output a phase-shifted multi-channel control signal.

19 Claims, 9 Drawing Sheets

PHASE SHIFT CIRCUIT AND BACKLIGHT UNIT HAVING THE SAME

The present application claims priority under 35 U.S.C. 119 and 35 U.S.C. 365 to Korean Patent Application No. 10-2007-0037531 (filed on Apr. 17, 2007) and Korean Patent Application No. 10-2007-0059776 (filed on Jun. 19, 2007), which are hereby incorporated by references in its entirety.

BACKGROUND

The embodiment relates to a phase shift circuit and a backlight unit having the same.

A backlight unit provides light for image display to a display device such as a liquid crystal display device. The backlight unit comprises a light emitting unit and an inverter circuit. The light emitting unit emits light and the inverter circuit controls the driving of the light emitting unit.

The inverter circuit must supply voltage sufficient for turning the light emitting unit on and off. To this end, the inverter circuit comprises a transformer capable of boosting input voltage and a switching unit for controlling the driving of the transformer.

The light emitting unit may be divided into a plurality of groups. Each group can be separately driven by an additional control signal. Each group may be expressed by a single channel, and the inverter circuit may drive a single channel or multi-channel.

A multi-channel light emitting unit may be driven using a plurality of inverter circuits, which correspond to the number of channels, capable of driving a single channel. Further, the light emitting unit may be driven using an inverter circuit capable of driving multi-channel. In such a case, the inverter circuit can provide a control signal to the multi-channel by using one Pulse Width Modulation (PWM) module. The control signal output from the PWM module is provided to the switching unit that controls the driving of the transformer provided in each channel.

Each control signals provided from the PWM module to a plurality of channels may have the same phase. As illustrated in FIG. 1, control signals having the same phase may be simultaneously provided to a plurality of channels.

Further, each control signals provided from the PWM module to a plurality of channels may have different phases separated from each other without overlapping with each other. As illustrated in FIG. 2, after a control signal provided to a single channel comes into an off state, a control signal sequentially provided to another channel may enter an on state.

The PWM module provides the switching unit with a control signal having an adjusted duty ratio to control the brightness of light step by step, which is emitted from the light emitting unit. However, when the PWM module performs burst dimming control in the manner as described above, much noise may be generated or wave noise may be generated.

SUMMARY

The embodiment relates to a phase shift circuit capable of preventing noise and wave noise from being generated when performing dimming control, and a backlight unit having the same.

A phase shift circuit according to an embodiment comprising: a frequency multiplier outputting a square wave signal by frequency-multiplying a reference signal; a frequency synchronizer receiving the square wave signal to output a triangle wave signal; and a PWM module receiving the triangle wave signal to output a phase-shifted multi-channel control signal.

A backlight unit according to an embodiment comprising: a frequency multiplier outputting a square wave signal by frequency-multiplying a reference signal; a frequency synchronizer receiving the square wave signal to output a triangle wave signal; a PWM module receiving the triangle wave signal to output a phase-shifted multi-channel control signal; a light emitting unit emitting light; and an inverter circuit receiving the control signal to provide the light emitting unit with a driving signal.

DETAILED DESCRIPTION OF THE EMBODIMENTS

Hereinafter, an embodiment will be described with reference to the accompanying drawings.

Figure 1:
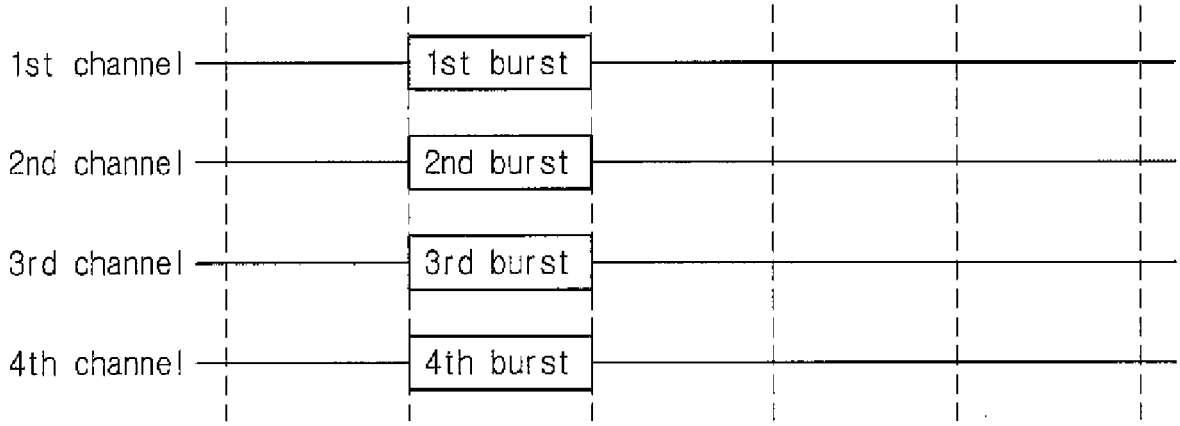
Fig. 1 Related Art
FIGS. 1 and 2 are views illustrating an example in which a PWM module provides a control signal to each channel.
Figure 2:
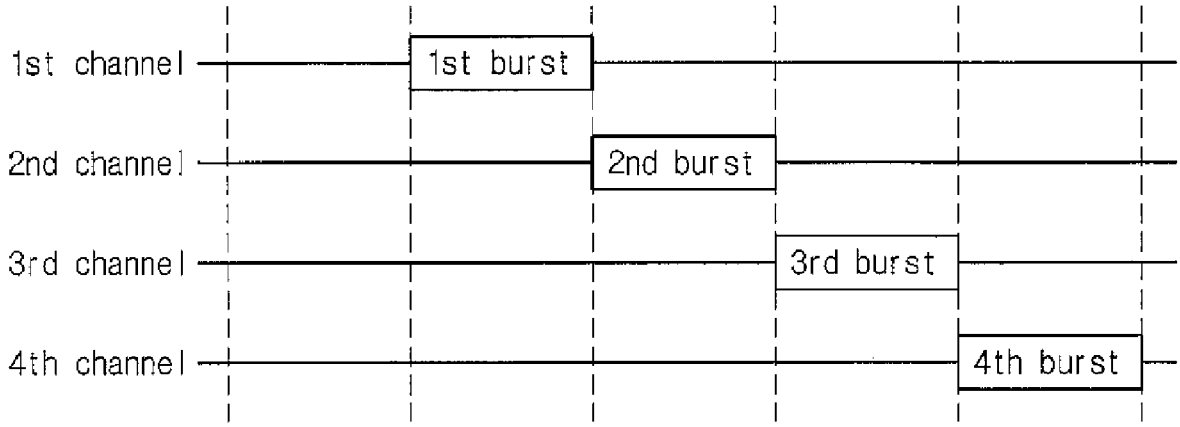
Fig.2 Related Art
Figure 3:
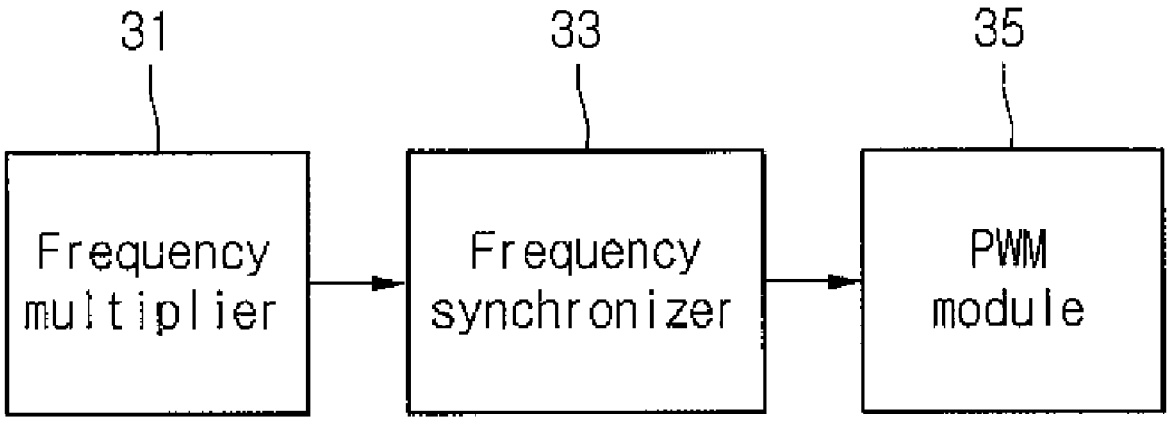
FIG. 3 is a block diagram illustrating a phase shift circuit according to an embodiment.

FIG. 3 is a block diagram illustrating a phase shift circuit according to an embodiment.

As illustrated in FIG. 3, the phase shift circuit according to the embodiment comprises a frequency multiplier 31, a frequency synchronizer 33 and a PWM module 35.

The frequency multiplier 31 outputs a square wave signal by frequency-multiplying a reference signal. The frequency multiplier 31 outputs a frequency signal by multiplying a received frequency signal by an integer time. The frequency multiplier 31 outputs the frequency signal by multiplying a received frequency using harmonics.

The frequency multiplier 31 may be an additional hardware, and may also be embedded in an integrated control IC such as a main controller IC. The reference signal may be provided from an apparatus to which the phase shift circuit according to the embodiment is applied. For example, when the phase shift circuit according to the embodiment is applied to a display device, the reference signal may comprise a vertical frequency provided from the display device in order to display an image.

The frequency synchronizer 33 receives the square wave signal output from the frequency multiplier 31. Further, the frequency synchronizer 33 outputs a triangle wave signal synchronized with the reference signal. The frequency synchronizer 33 controls the output triangle wave signal to be synchronized with the reference signal.

The PWM module 35 receives the synchronized triangle wave signal output from the frequency synchronizer 33. Further, the PWM module 35 outputs a synchronized and phase-shifted multi-channel control signal. The PWM module 35 can be prepared in the form of an IC.

Figure 4:
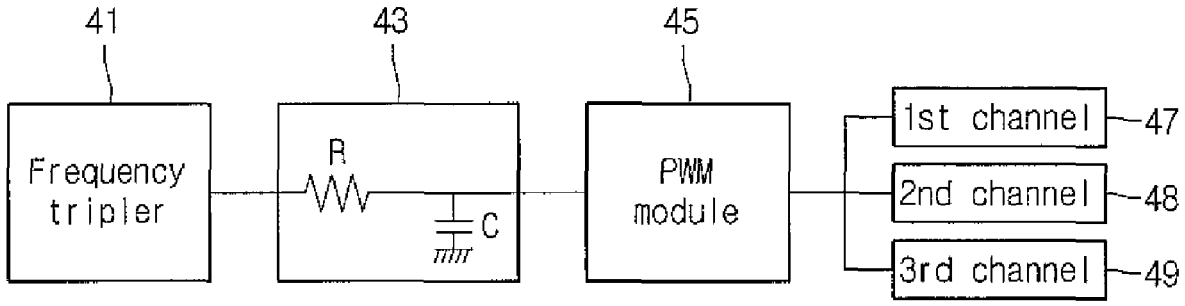
FIG. 4 is a view illustrating the phase shift circuit according to the embodiment.

FIG. 4 is a view illustrating the phase shift circuit according to the embodiment, which shows an example employing a frequency tripler.

As illustrated in FIG. 4, the phase shift circuit according to the embodiment comprises frequency tripler 41, a frequency synchronizer 43 and a PWM module 45.

The frequency tripler 41 outputs a square wave signal multiplied by three times as compared with a reference signal. For example, the reference signal may have a frequency of 60 Hz and the frequency tripler 41 may output a 180 Hz signal. Further, the reference signal may comprise a pulse signal of 60 Hz, 3.3V and 10 μs. At this time, the frequency tripler 41 may output a 180 Hz square wave signal having 5V and a duty of 50%.

The frequency synchronizer 43 outputs a triangle wave signal synchronized with the reference signal. The frequency synchronizer 43 may comprise a resistor R and a capacitor C. The resistor R may be serially connected between the frequency tripler 41 and the PWM module 45. The capacitor C has one end connected in parallel between the resistor R and the PWM module 45. Further, the capacitor C has the other end connected to the ground. The frequency synchronizer 43 may comprise a plurality of resistors or capacitors, and may also be prepared in the form of a plurality of R-C parallel filters.

The triangle wave signal output from the frequency synchronizer 43 is input to the PWM module 45. For example, the synchronized triangle wave signal may be input to a triangle wave input terminal provided in the PWM module 45.

The PWM module 45 outputs a burst mode multi-channel control signal phase-synchronized or phase-shifted in each channel. For example, the channel may comprise a first channel 47, a second channel 48 and a third channel 49. According to the embodiment as described above, synchronization in each channel can be achieved using the 180 Hz triangle wave synchronization signal generated from the frequency tripler 41 and the frequency synchronizer 43, and a phase shift function can also be performed.

Figure 5:
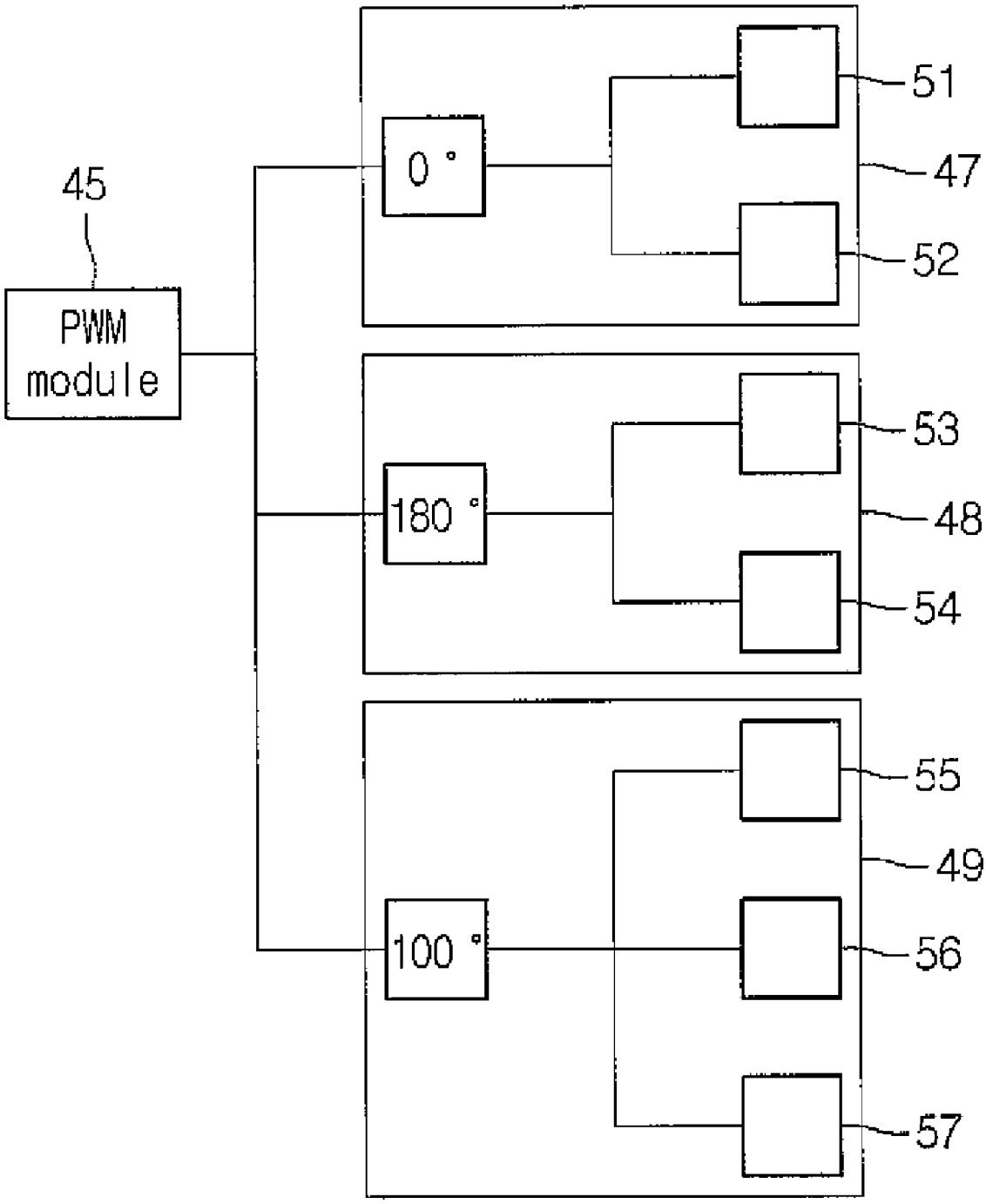
FIG. 5 is a view illustrating a control signal provided to each channel from a PWM module according to an embodiment.

FIG. 5 is a view illustrating a control signal provided to each channel from the PWM module according to the embodiment.

As illustrated in FIG. 5, the PWM module 45 may output 3-blocked multi-channel control signal by setting a phase of each channel to a different level. In detail, the PWM module 45 may perform burst dimming control by outputting a multi-channel control signal, which is 180 Hz-synchronized in each channel and phase-shifted to an angle of 0°, 180° and 100°, by means of the 180 Hz triangle wave synchronization signal.

For example, when the phase shift circuit according to the embodiment is applied to a display device comprising light emitting units, two light emitting units 51 and 52 may be provided to the first channel 47, two light emitting units 53 and 54 may be provided to the second channel 48, and three light emitting units 55, 56 and 57 may be provided to the third channel 49. At this time, the PWM module 45 may perform the burst dimming control by outputting a multi-channel control signal 180 Hz-synchronized in each channel and phase-shifted to an angle of 0°, 180° and 100°.

Meanwhile, the multiplied square wave signal output from the frequency tripler 41 is not directly provided to the PWM module 45. That is, the square wave signal is converted to the 180 Hz triangle wave synchronization signal through the frequency synchronizer 43 and then provided to the PWM module 45. According to the embodiment, the 180 Hz signal output from the frequency tripler 41 may be converted to a stable synchronization signal of a triangle waveform through charging and discharging in the capacitor C connected in parallel to the resistor R.

At this time, the current amount of the 180 Hz triangle wave synchronization signal provided to the PWM module 45 is determined by a resistance value. If the amount of current is excessively great, the duty ratio in each channel may be different from each other. In contrast, if the amount of current is excessively small, the signal may not be synchronized. Thus, the resistance value must be set such that the synchronization signal can be maintained.

Figure 6:
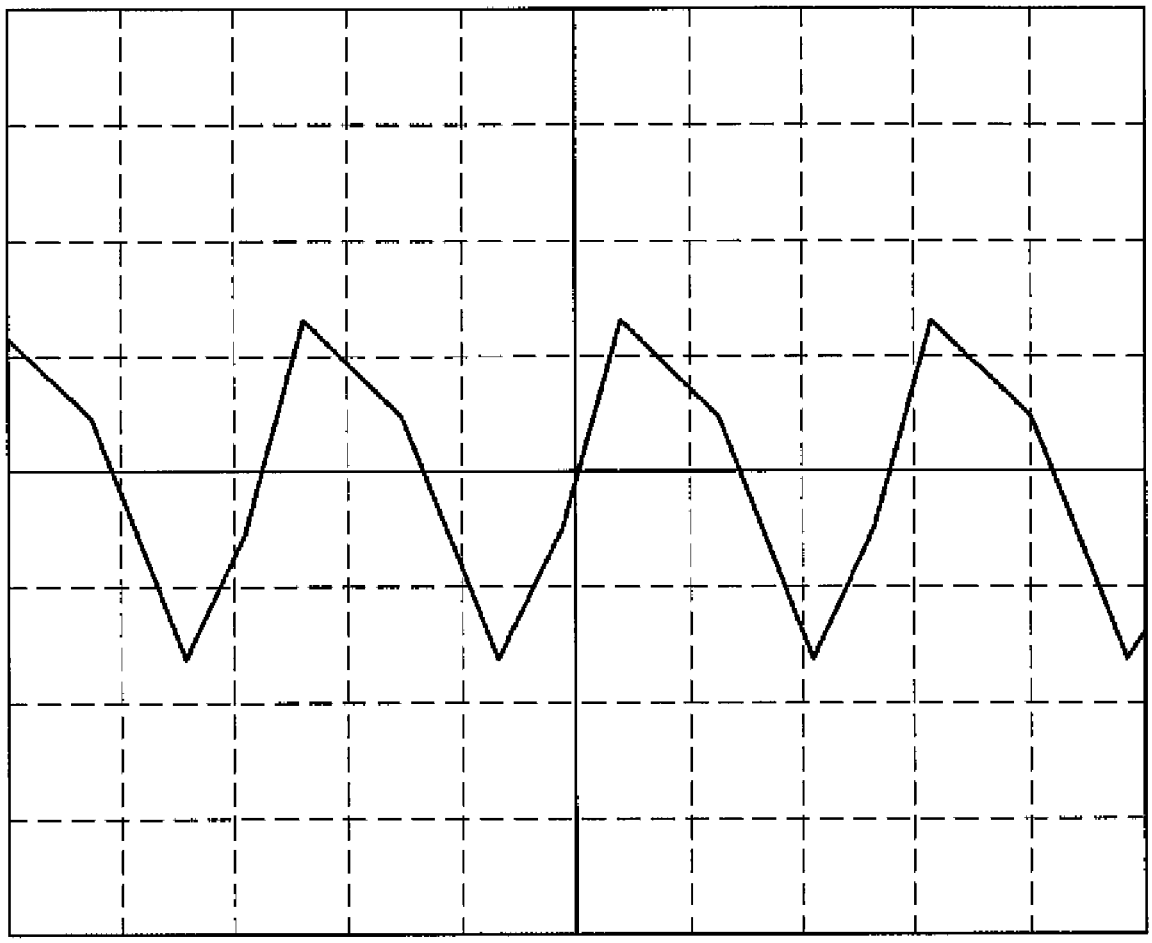
FIGS. 6 and 7 are waveforms of a signal input to a PWM module according to an embodiment.
Figure 7:
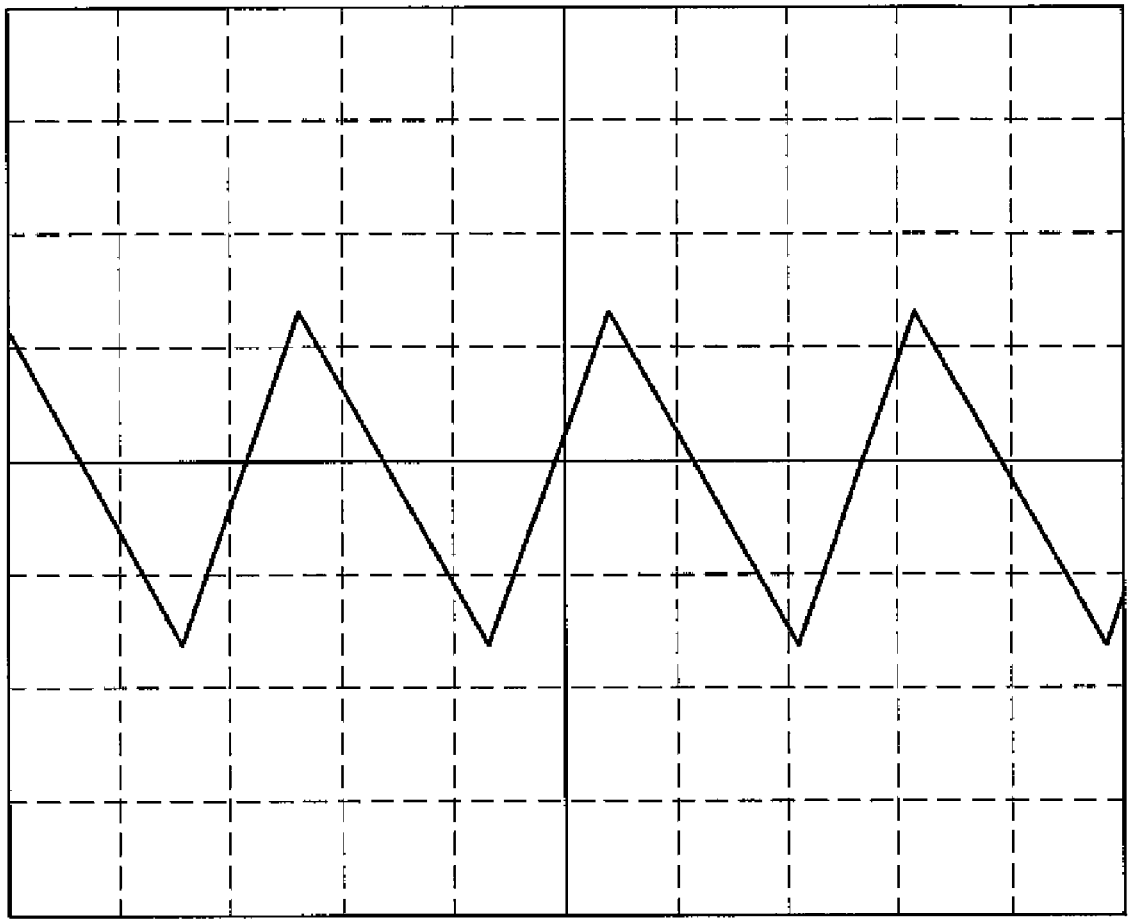

For example, as illustrated in FIG. 6, when the resistance vale is set to 1 M[Ω], the synchronization is ensured, but the duty ratio in each channel may be different from each other due to a triangle waveform. Further, when the resistance vale is set to 10 M[Ω], the duty ratio is ensured, but the signal may not be synchronized. However, as illustrated in FIG. 7, when the resistance value is set to 5 M[Ω] of an optimum value, the synchronization and duty ratio can be reliably ensured. The resistance value is for illustrative purpose only. The resistance value may be varied in an actual embodiment depending on environment.

Figure 8:
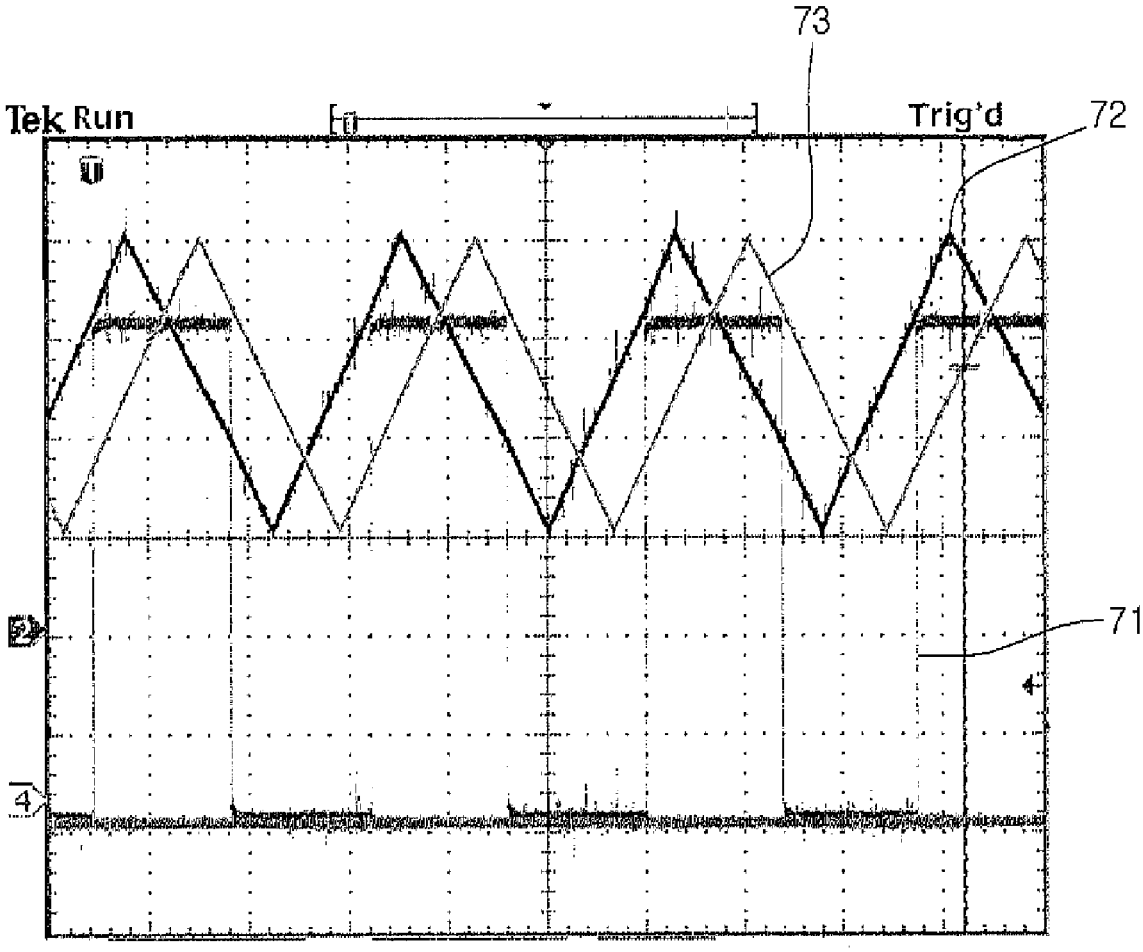
FIG. 8 is a view illustrating synchronization between signals in a phase shift circuit according to an embodiment.

FIG. 8 is a waveform measured after a resistance value is set such that the synchronization signal input to the PWM module 45 can be maintained. Referring to FIG. 8, it can be understood that triangle wave synchronization signals 72 and 73 passing through the frequency synchronizer 43 are synchronized with a square wave synchronization signal 71 output from the frequency tripler 41.

In the above description, the 3-multiple frequency multiplication is performed using the frequency tripler 41. However, the embodiment is not limited thereto. The embodiment may also use frequency multipliers that multiply a signal by various multiples.

Figure 9:
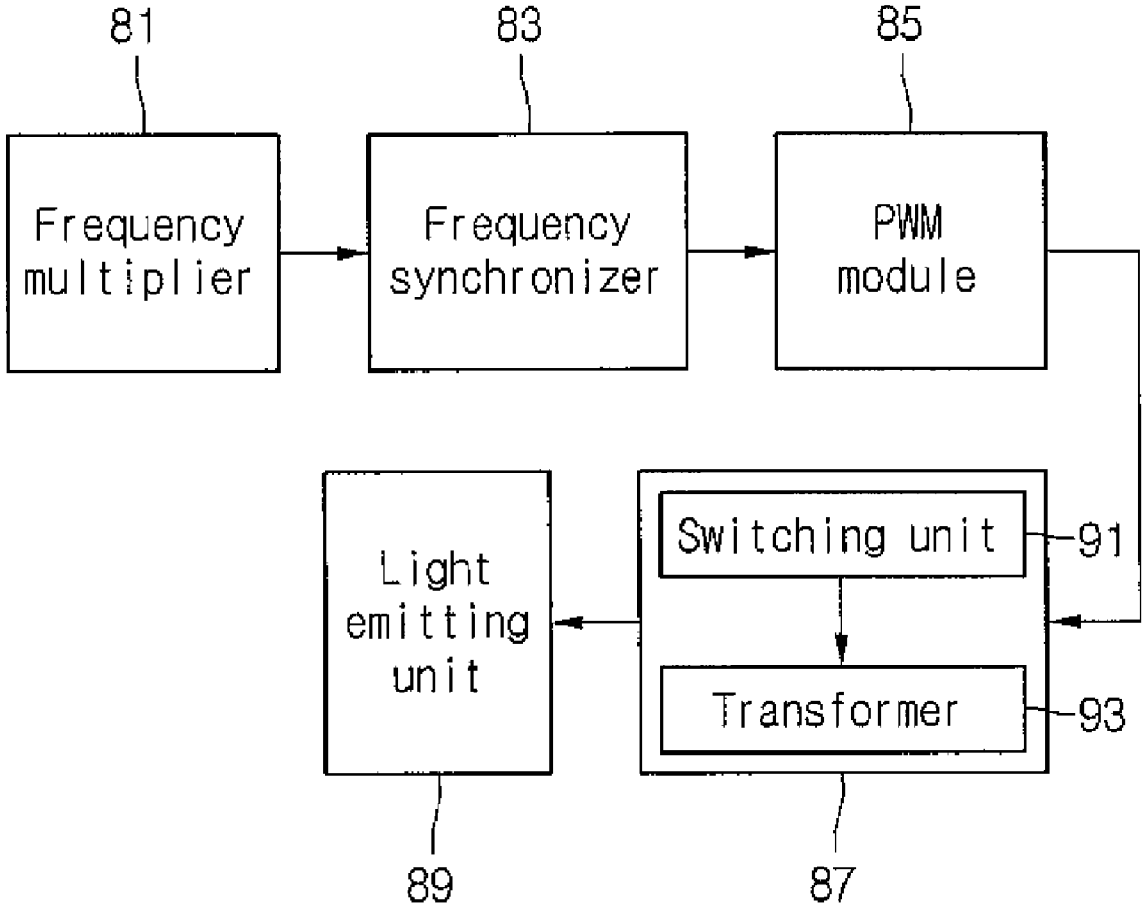
FIG. 9 is a block diagram of a backlight unit according to the embodiment.

The phase shift circuit as described above is for illustrative purpose only, and may be applied to a backlight unit. FIG. 9 is a block diagram of a backlight unit according to the embodiment.

As illustrated in FIG. 9, the backlight unit according to the embodiment comprises a frequency multiplier 81, a frequency synchronizer 83, a PWM module 85, an inverter circuit 87 and a light emitting unit 89.

The frequency multiplier 81 outputs a square wave signal by frequency-multiplying a reference signal. The frequency synchronizer 83 receives the square wave signal output from the frequency multiplier 81, and outputs a triangle wave signal synchronized with the reference signal. Further, the frequency synchronizer 83 controls the triangle wave signal to be synchronized with the reference signal.

The PWM module 85 receives the synchronized triangle wave signal output from the frequency synchronizer 83. Further, the PWM module 85 outputs a synchronized and phase-shifted multi-channel control signal. The inverter circuit 87 comprises a transformer 93 boosting input voltage and a switching unit 91 controlling the driving of the transformer 93. The control signal provided from the PWM module 85 may be provided to the switching unit 91. The switching unit 91 may comprise a FET as an example.

The inverter circuit 87 provides the light emitting unit 89 with a driving signal. Thus, the light emitting unit 89 emits light. The backlight unit as described above provides light for image display to a display device such as a liquid crystal display device.

The light emitting unit 89 may be divided into a plurality of groups. Each group may be driven by an additional control signal. Each group of the light emitting unit 89 may be expressed by a single channel. The inverter circuit 87 may drive a single channel or multi-channel.

According to the embodiment as described above, burst dimming waveform distribution is performed by adding a phase shift function while achieving synchronization, so that wave noise as well as noise can be prevented from being generated.

Any reference in this specification to "one embodiment", "an embodiment", "example embodiment" etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A phase shift circuit comprising:

a frequency multiplier outputting a square wave signal by frequency-multiplying a reference signal;

a frequency synchronizer receiving the square wave signal to output a triangle wave signal; and a PWM module receiving the triangle wave signal to output a phase-shifted multi-channel control signal.

2. The phase shift circuit as claimed in claim 1, wherein the frequency synchronizer comprises a resistor and a capacitor.

3. The phase shift circuit as claimed in claim 2, wherein the resistor is serially connected between the frequency multiplier and the PWM module, and the capacitor is connected in parallel between the resistor and the PWM module.

4. The phase shift circuit as claimed in claim 2, wherein the capacitor is connected to a ground.

5. The phase shift circuit as claimed in claim 1, wherein the frequency multiplier is a frequency tripler that multiplies frequency of the input reference signal by three times.

6. The phase shift circuit as claimed in claim 5, wherein the reference signal has a frequency of 60 Hz and the triangle wave signal has a frequency of 180 Hz.

7. The phase shift circuit as claimed in claim 1, wherein the PWM module is an IC that outputs the phase-shifted multi-channel control signal, which maintains synchronization in each channel, by using the reference signal.

8. The phase shift circuit as claimed in claim 1, wherein the frequency synchronizer receiving the square wave signal to output the triangle wave signal synchronized with the reference signal, and the PWM module receiving the synchronized triangle wave signal to output a synchronized and phase-shifted multi-channel control signal.

9. A backlight unit comprising:

a frequency multiplier outputting a square wave signal by frequency-multiplying a reference signal;

a frequency synchronizer receiving the square wave signal to output a triangle wave signal;

a PWM module receiving the triangle wave signal to output a phase-shifted multi-channel control signal;

a light emitting unit emitting light; and an inverter circuit receiving the control signal to provide the light emitting unit with a driving signal.

10. The backlight unit as claimed in claim 9, wherein the frequency synchronizer comprises a resistor and a capacitor.

11. The backlight unit as claimed in claim 10, wherein the resistor is serially connected between the frequency multiplier and the PWM module, and the capacitor is connected in parallel between the resistor and the PWM module.

12. The backlight unit as claimed in claim 10, wherein the capacitor is connected to a ground.

13. The backlight unit as claimed in claim 9, wherein the frequency multiplier is frequency tripler that multiplies frequency of the input reference signal by three times.

14. The backlight unit as claimed in claim 13, wherein the reference signal has a frequency of 60 Hz and the triangle wave signal has a frequency of 180 Hz.

15. The backlight unit as claimed in claim 9, wherein the PWM module is an IC that outputs the phase-shifted multi-channel control signal, which maintains synchronization in each channel, by using the reference signal.

16. The backlight unit as claimed in claim 9, wherein the inverter circuit comprises a transformer boosting input voltage and a switching unit controlling driving of the transformer.

17. The backlight unit as claimed in claim 16, wherein the control signal is provided to the switching unit.

18. The backlight unit as claimed in claim 16, wherein the switching unit comprises a FET.

19. The backlight unit as claimed in claim 9, wherein the frequency synchronizer receiving the square wave signal to output the triangle wave signal synchronized with the reference signal, and the PWM module receiving the synchronized triangle wave signal to output a synchronized and phase-shifted multi-channel control signal.

* * * * *